US007263747B1

(12) United States Patent
Semons

(10) Patent No.: US 7,263,747 B1
(45) Date of Patent: Sep. 4, 2007

(54) ZIPPER ATTACHMENT AND A METHOD OF MAKING THE IMPROVED ZIPPER ATTACHMENT

(76) Inventor: William E. Semons, 19 Hubon St., Salem, MA (US) 01970

( * ) Notice: Subject to any disclaimer, the term of this patent is extended or adjusted under 35 U.S.C. 154(b) by 209 days.

(21) Appl. No.: 11/017,925

(22) Filed: Dec. 22, 2004

(51) Int. Cl.
*A44B 19/00* (2006.01)

(52) U.S. Cl. ..... 24/361; 24/398; 24/304

(58) Field of Classification Search ..... 24/381, 24/384, 389, 304, 391, 397, 398, 403
See application file for complete search history.

(56) References Cited

U.S. PATENT DOCUMENTS 3,785,014 A * 1/1974 Canepa ..... 24/381
4,083,582 A * 4/1978 Villafana ..... 281/20
4,265,190 A * 5/1981 Moertel ..... 112/152
4,353,760 A * 10/1982 Moertel ..... 156/66
5,067,207 A 11/1991 Semons ..... 24/381
D331,892 S 12/1992 Semons ..... D11/221
5,311,648 A 5/1994 Semons ..... 24/381
2003/0019085 A1* 1/2003 Loglisci ..... 24/304

* cited by examiner

*Primary Examiner*—James R. Brittain
(74) *Attorney, Agent, or Firm*—Terry M. Gerstein

(57) ABSTRACT

A zipper mechanism is stitched to one side of a base which has a layer of adhesive on the other side. A release liner covers the adhesive and includes a plurality of rows of slits which define sections which are separated from each other. The zipper mechanism is attached to the base by rows of stitches with the rows of stitches being located between sections of the release liner so the release liner can be separated from an adhesive layer covering position in sections without interference by the stitching. The zipper mechanism is formed by a method which slits the release liner just prior to stitching the zipper mechanism to the base and locating each row of stitches between adjacent rows of slits defined in the release liner.

6 Claims, 3 Drawing Sheets

A method of producing an improved zipper unit

ZIPPER ATTACHMENT AND A METHOD OF MAKING THE IMPROVED ZIPPER ATTACHMENT

TECHNICAL FIELD OF THE INVENTION

The present invention relates to the general art of closures, and to the particular field of reusable closures.

BACKGROUND OF THE INVENTION

Many different items are covered by tarpaulins or the like to protect such items from damage. An automobile is one common example of such covered items. Boats, agricultural equipment, air vehicles, or the like are further examples of such items.

Once covered, it is often necessary to gain access to such covered items for service or maintenance. If the seal is broken on many covers for such items, the cover is compromised and must be replaced.

Therefore, there is a need for a means for covering items in a manner that will permit access to the covered item without damaging the cover in a manner that will compromise the cover of a re-covered item.

Buildings often have openings that should be closed when not in use. A cargo or other access opening is an example of such openings. In some cases, doorways should be sealed when not in use.

Therefore, there is a need for a means for covering a building opening in a manner that will permit access through the opening when desired and re-sealing of the opening when desired.

Furthermore, some items, such as coffee, are shipped in bulk. In some cases, the shipping containers must be opened for inspection, such as by customs officials or the like.

It is often convenient to temporarily open the coverings of such items and to then re-close the container or cover. In the case of coffee, it is often convenient to slit open the bag to inspect the contents, and then re-close the bag after inspection.

However, in some cases, once the covering or container is opened, it cannot be easily re-closed in a manner that will seal the contents. In such instances, the entire bag may be lost. This can be costly and wasteful.

Therefore, there is a need for a means for permitting a container to be opened and then re-closed in an easy yet secure manner.

In U.S. Pat. Nos. 5,311,648, 5,067,207 and Des 331,892, the present inventor has disclosed a zipper attachment that will achieve the above-stated goals. This zipper attachment includes a one-piece cloth base which has a zipper mechanism mounted on one side thereof and adhesive located on another side thereof. A release liner covers the adhesive until the attachment is needed. The attachment is used by removing the release layer, adhering the base to an element, such as a bag or a tarpaulin, opening the zipper mechanism, and cutting a hole through the base and through the element. The cut will define an access opening through the element. After use is made of the access opening, the zipper mechanism is closed to re-seal the element.

It is noted that the disclosure of the aforementioned patents, U.S. Pat. Nos. 5,311,648, 5,067,207 and Des 331, 892 is incorporated herein by reference.

While the attachment disclosed in the aforementioned patents works well, the inventor has noted a problem. The zipper mechanism is mounted on the base by stitching the zipper mechanism to the base. In the devices disclosed in the incorporated patents, the zipper mechanism is stitched to a base after the adhesive and the release liner are already located on the base. The zipper mechanism is stitched to this base on the side of the base opposite to the adhesive covered side.

While this is an efficient means for mounting the zipper mechanism on the base, it has created a problem with removing the release liner just prior to mounting the attachment to an element. The stitching makes it difficult to remove the release liner and the inventor has found that the release liner must be removed in sections and even then, some of the liner may remain in place due to the stitching. The release liner used can come apart in layers leaving parts of the release liner adhered to the stitching. Also, pulling of the release liner to tear it from the stitching which holds the zipper mechanism in place may stretch the stitching thereby weakening the purpose of the stitching. In some cases, pulling the release liner from the stitching may even damage or break the stitching.

Therefore, there is a need to improve the zipper mechanism disclosed in U.S. Pat. Nos. 5,311,648, 5,067,207 and Des 331,892.

Furthermore, there is a need to improve the method of making a zipper attachment such as disclosed in U.S. Pat. Nos. 5,311,648, 5,067,207 and Des 331,892.

OBJECTS OF THE INVENTION

It is a main object of the present invention to provide an improvement to the zipper mechanism disclosed in U.S. Pat. Nos. 5,311,648, 5,067,207 and Des 331,892.

It is another object of the present invention to provide a method for producing a zipper mechanism such as disclosed in U.S. Pat. Nos. 5,311,648, 5,067,207 and Des 331,892.

SUMMARY OF THE INVENTION

These, and other, objects are achieved by a zipper unit that is an improved version of the zipper unit disclosed in the incorporated patents. The improved zipper unit embodying the present invention includes a one-piece base having a zipper mechanism mounted on one surface thereof and a layer of adhesive on a second surface thereof. Two rows of stitches attach the zipper mechanism to the base. A release liner covers the adhesive layer and is divided into a plurality of separate sections which are spaced apart from each other by the rows of stitches that attach a zipper mechanism to a base. The release liner can thus be removed in sections.

Using the improved zipper mechanism embodying the present invention will permit a user to easily and cleanly remove the release liner without interference from the stitches while the release liner is securely held on the base covering the layer of adhesive until the zipper mechanism is to be used.

BRIEF DESCRIPTION OF THE DRAWING FIGURES

DETAILED DESCRIPTION OF THE PREFERRED EMBODIMENT OF THE INVENTION

Figure 1:
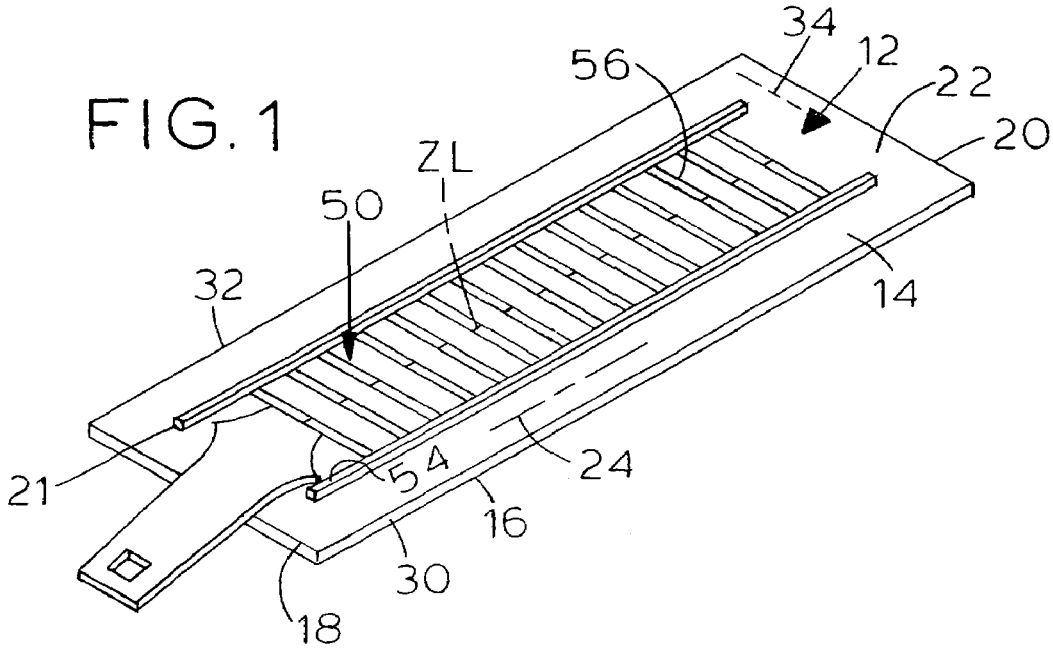
FIG. 1 is a top perspective view of an improved zipper mechanism embodying the present invention.

Other objects, features and advantages of the invention will become apparent from a consideration of the following detailed description and the accompanying drawings.

Referring to the figures, it can be understood that the present invention is embodied in an improved zipper unit 10 which can be applied to a support surface, such as a tarpaulin, a container, or the like and provide a re-sealable access opening through that support surface. In this manner, the support surface can be cut, but will not be compromised because the opening can be re-sealed.

Unit 10 comprises a monolithic one-piece base 12 which has a first surface 14 which is an outer surface when base 12 is in use on a support. A second surface 16 is an undersurface when base 12 is in use. Base 12 further includes a first end 18, a second end 20 and a longitudinal axis 24 which extends between first end 18 and second end 20.

A first side 30 and a second side 32 are spaced apart along a transverse axis 34 which extends between first side 30 and second side 32.

A layer 40 of adhesive is located on second surface 16 of base 12 and is of the pressure sensitive type adhesive that will adhere to a surface upon contact.

A zipper mechanism 50 is mounted on first surface 14 and extends in the direction of longitudinal axis 24. Zipper mechanism 50 includes a first surface 52 which is an outside surface when zipper mechanism 50 is mounted on base 12 as shown in FIG. 1. Zipper mechanism 50 further includes a second surface 54 which is an inside surface when zipper mechanism 50 is mounted on base 12 as shown in FIG. 1. Second surface 54 is located adjacent to first surface 14 of base 12 when zipper mechanism 50 is mounted on base 12.

Zipper teeth 56 are located adjacent to first surface 14 of base 12 when the zipper mechanism is mounted on base 12 and are separate from base 12. This permits the zipper mechanism to be operated separately from any support element on which base 12 is mounted. This feature is fully explained in the incorporated patents and allows unit 10 to be placed on a support element, an opening defined in the support element through base 12, and the zipper mechanism opened and closed to open and close the opening thus defined through the support element. For example, a bag of coffee may be shipped in a one-piece condition but must be opened by customs officials upon entry into a United States port. Unit 10 would be placed on the one-piece bag, the zipper mechanism opened, a slit made through base 12 and through the bag to provide access to the coffee in the bag. Once the customs official has confirmed that the contents of the bag are coffee beans, the bag can be re-closed by simply operating the zipper mechanism and the bag is again securely closed. The bag need not be sacrificed for the inspection.

A first row 60 of stitches attach zipper mechanism 50 to base 12 and extend in the direction of longitudinal axis 24. A second row 62 of stitches attach zipper mechanism 50 to base 12. Second row 62 of stitches extends in the direction of longitudinal axis 24 and is spaced apart from first row 60 of stitches in the direction of transverse axis 34 of base 12.

Figure 2:
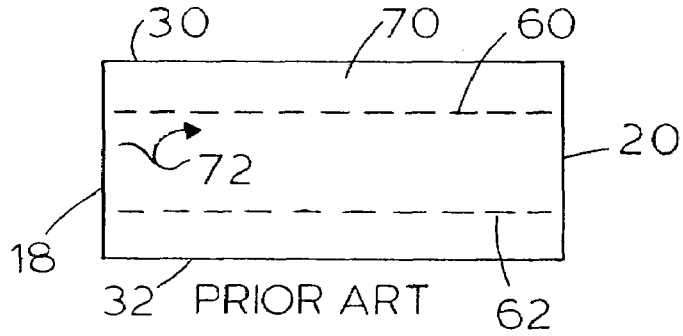
FIG. 2 is a rear plan view of a prior art zipper mechanism such as disclosed in the incorporated patents.

A release liner 70 is releasably attached to base 12 by layer 40 of adhesive. As shown in FIG. 2, release liner 70 is one piece and stitches 60 and 62 extend through the release liner. As discussed above, to expose the adhesive, the release liner must be removed. This is achieved by pealing the release liner off of the adhesive as indicated by arrow 72. As was discussed above, the stitching makes it difficult to remove the release liner from base 12 in the prior art unit shown in FIG. 2.

Figure 3:
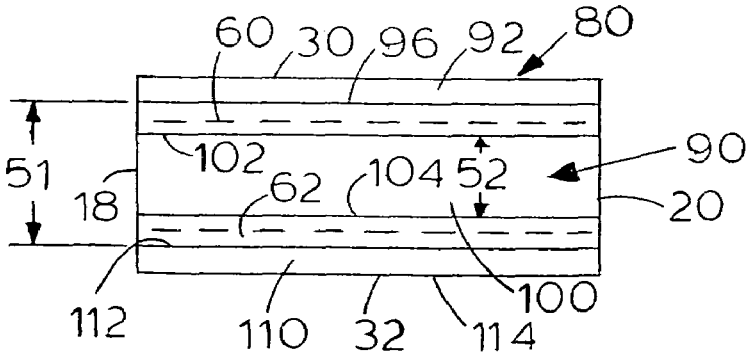
FIG. 3 is a rear plan view of the zipper mechanism embodying the present invention.
Figure 4:
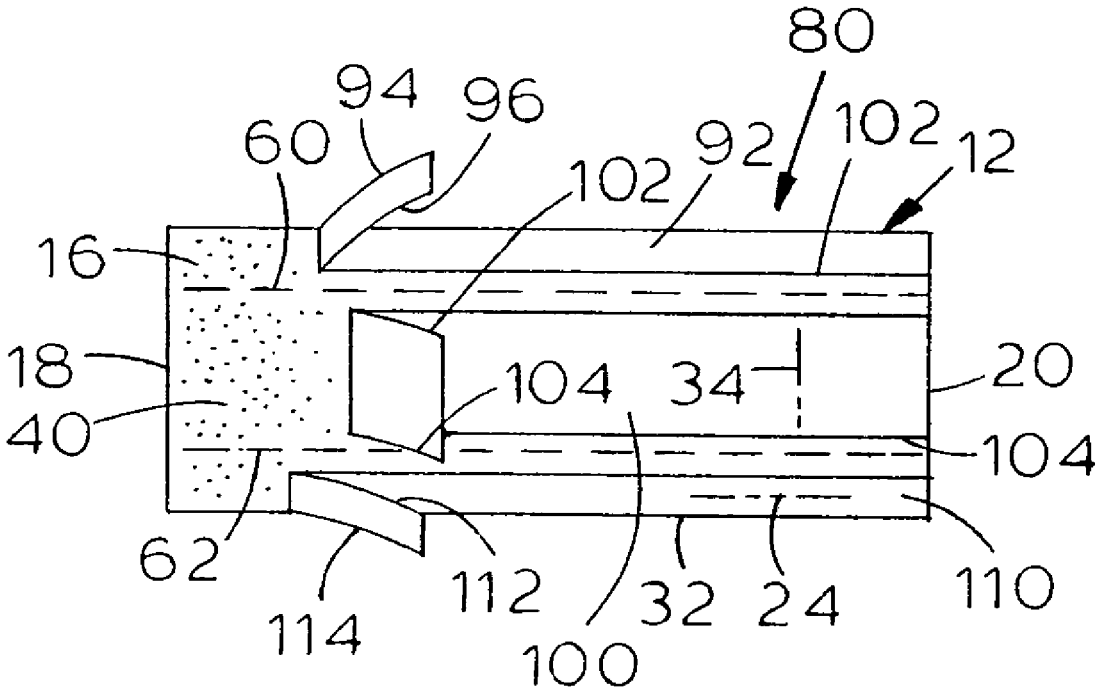
FIG. 4 is a rear plan view of the zipper mechanism embodying the present invention with the release liners partially removed to demonstrate the sectioned nature of the release layer of the present invention.

This drawback is overcome in the unit 80 shown in FIGS. 3 and 4, and attention is now directed to these figures. Unit 80 has a zipper mechanism similar to the above-discussed zipper mechanism and, once placed on a support element, operates in a manner similar to the above-discussed unit 10. Accordingly, the zipper mechanism of unit 80 will not be discussed, but attention is directed to the above discussion as well as the discussion in the incorporated patents.

Unit 80 includes a release liner 90 which is easily removed from base 12 as the stitching used to mount the zipper mechanism on the base does not interfere with the removal of the release liner from the base.

As shown in FIGS. 3 and 4, release liner 90 includes a first section 92 which extends between first end 18 of base 12 and second end 20 of base 12. First section 92 of release liner 90 has a first side edge 94 located adjacent to first side 30 of base 12 and a second side 96 which is located adjacent to first row 60 of stitching.

A second section 100 of release liner 90 extends between first end 18 of base 12 and second end 20 of base 12 and has a first side edge 102 located adjacent to first row 60 of stitching and a second side edge 104 located adjacent to second row 62 of stitching.

A third section 110 of release liner 90 extends between first end 18 of base 12 and second end 20 of base 12 and has a first side edge 112 located adjacent to second row 62 of stitching and a second side edge 114 located adjacent to second side 32 of base 12.

First row 60 of stitching separates first section 92 of release liner 90 from second section 100 of release liner 90 and second row 62 of stitching separates second section 100 of release liner 90 from third section 110 of release liner 90.

The first, second and third sections of release liner 90 are separate and independent of each other whereby each of the first, second and third sections of release liner 90 can be removed from base 12 independent of the other sections of release liner 90. This independent removal is indicated in FIG. 4. The stitching will not interfere with the removal of the sections of the release liner to expose layer 40 of adhesive. As can be understood from FIG. 4, adjacent edges of the release liner sections are spaced apart from each other and from the rows of stitching to further ensure the independence of the release liner sections and to further ensure that the stitching will not interfere with the removal of the release liner sections.

Figure 5:
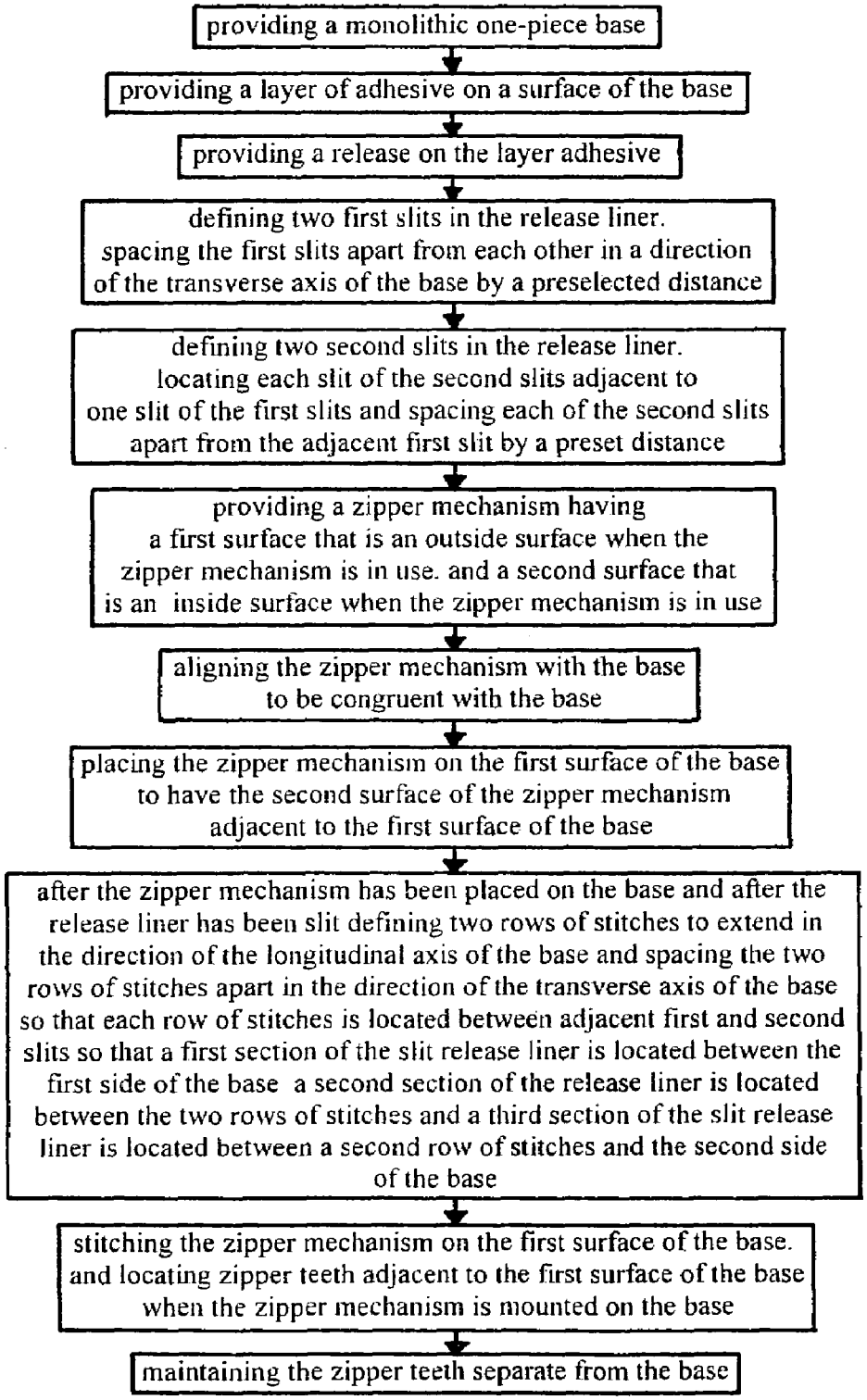
FIG. 5 is a listing of the steps included in the method embodying the present invention.

Referring to FIG. 5, the steps comprising the method of forming unit 80 are presented. The method of producing improved zipper unit 80 comprises providing monolithic one-piece base 12 having first surface 14 which is an outer surface when base 12 is in use, second surface 16 which is an undersurface when base 12 is in use, first end 18, second end 20, longitudinal axis 24 which extends between the first end and the second end, first side 30, second side 32 and transverse axis 34 which extends between the first side and the second side; providing layer 40 of adhesive on second surface 16 of the base; providing release liner 70 on the layer adhesive; defining two first slits, designated in FIG. 3 as slits 96 and 112, in the release liner to extend in the direction of the longitudinal axis of the base, spacing the first slits in the release liner apart from each other in the direction of the transverse axis of the base by a preselected distance, designated in FIG. 3 as preselected distance S1; defining two second slits, designated in FIG. 3 as slits 102 and 104, in the release liner to extend in the direction of the longitudinal axis of the base, locating each slit of the second slits adjacent to one slit of the first slits and spacing each of the second slits apart from the adjacent first slit by a preset distance, designated in FIG. 3 by preset distance S2; providing zipper mechanism 50 having a first end designated in FIG. 1 as first end Z1, a second end, designated in FIG. 1 as second end Z2 and a longitudinal axis, designated in FIG. 1 as longitudinal axis ZL, which extends between first end Z1 and second end Z2, first surface 52 that is an outside surface when zipper mechanism 50 is in use, and second surface 54 that is an inside surface when zipper mechanism 50 is in use; aligning zipper mechanism 50 with base 12 to be congruent with base 12; placing zipper mechanism 50 on first surface 52 of base 12 to have second surface 54 of the zipper mechanism adjacent to first surface 14 of base 12; after the zipper mechanism has been placed on the base and after the release liner has been slit, defining two rows of stitches, designated in FIG. 4 as rows 60 and 62, to extend in the direction of longitudinal axis 24 of base 12 and spacing the two rows of stitches 60 and 62 apart in the direction of transverse axis 34 of base 12 so that each row of stitches is located between adjacent first and second slits so that first section 92 of the slit release liner is located between first row 60 of stitches and first side 30 of base 12, a second section 100 of the slit release liner is located between the two rows 60 and 62 of stitches and third section 110 of the slit release liner is located between second row 62 of stitches and second side 32 of the base; stitching zipper mechanism 50 on first surface 14 of the base to extend in the direction of longitudinal axis 24 of the base, and locating zipper teeth 56 adjacent to first surface 14 of the base when the zipper mechanism is mounted on the base; and maintaining the zipper teeth separate from the base.

It is noted that the release liner is slit while it is attached to the base material with a jig that is precisely set to slit the release liner but not the base material. The base material, with the slit liner, is then fed to a stitching machine to be stitched to a zipper mechanism with the stitches being located to be placed in the slits defined in the release liner. In this manner, the release liner can be easily removed from the base material without encountering the problems mentioned above with regard to a non-slit release liner.

The method further includes placing first section 92 of the sectioned release liner between first row 60 of stitches and first side 30 of the base, placing second section 100 of the sectioned release liner between first row 60 of stitches and second row 62 of stitches, and placing third section 110 of the sectioned release liner between second row 62 of stitches and second side 32 of the base. The method further includes spacing the sections of the sectioned release liner apart from the rows of stitches.

By sectioning the release liner before stitching the zipper mechanism to the base and locating the stitches to be in the sections defined by the slit release layer, a more efficient and cost-effective process is provided in which only one layer at a time is moved through the assembling machines.

It is understood that while certain forms of the present invention have been illustrated and described herein, it is not to be limited to the specific forms or arrangements of parts described and shown.

The invention claimed is:

1. An improved zipper unit comprising:

A) a monolithic one-piece base having
  (1) a first surface which is an outer surface when said base is in use,
  (2) a second surface which is an undersurface when said base is in use,
  (3) a first end,
  (4) a second end,
  (5) a longitudinal axis which extends between the first end and the second end,
  (6) a first side,
  (7) a second side, and
  (6) a transverse axis which extends between the first side and the second side;

B) a layer of adhesive on the second surface of said base;

C) a zipper mechanism mounted on the first surface of said base to extend in the direction of the longitudinal axis of said base, said zipper mechanism including
  (1) a first surface which is an outside surface when said zipper mechanism is mounted on said base,
  (2) a second surface which is an inside surface when said zipper mechanism is mounted on said base, the second surface of said zipper mechanism being located adjacent to the first surface of said base when said zipper mechanism is mounted on said base, and
  (3) zipper teeth which are located adjacent to the first surface of said base when said zipper mechanism is mounted on said base and are separate from said base;

D) a first row of stitches attaching said zipper mechanism to said base, said first row of stitches extending in the direction of the longitudinal axis of said base;

E) a second row of stitches attaching said zipper mechanism to said base, said second row of stitches extending in the direction of the longitudinal axis of said base and being spaced apart from said first row of stitches in the direction of the transverse axis of said base; and F) a release liner which is releasably attached to said base by said layer of adhesive, said release liner including
  (1) a first section which extends between the first end of said base and the second end of said base and which has a first side edge located adjacent to the first side of said base and a second side located adjacent to the first row of stitching,
  (2) a second section which extends between the first end of said base and the second end of said base and which has a first side edge located adjacent to the first row of stitching and a second side edge located adjacent to the second row of stitching,
  (3) a third section which extends between the first end of said base and the second end of said base and which has a first side edge located adjacent to the second row of stitching and a second side edge located adjacent to the second side of said base,
  (4) the first row of stitching separating the first section of said release liner from the second section of said release liner and the second row of stitching separating the second section of said release liner from the third section of said release liner, and
  (5) the first, second and third sections of said release liner being separate and independent of each other whereby each of the first, second and third sections of said release liner can be removed from said base independent of the other sections of said release liner.

2. The improved zipper unit defined in claim 1 wherein the first side edge of the second section of said release liner is spaced apart from the second side edge of the first section of said release liner, and the second side edge of the second section of said release liner is spaced apart from the first side edge of the third section of said release liner.

3. The improved zipper unit defined in claim 1 wherein the second side edge of the first section of said release liner is spaced apart from the first row of stitches, the first side edge of the second section of said release liner is spaced apart from the first row of stitches, the second side edge of the second section of said release liner is spaced apart from the second row of stitches and the first side edge of the third section of said release liner is spaced apart from the second row of stitches.

4. An improved zipper unit comprising:

A) a monolithic one-piece base having
  (1) a first surface which is an outer surface when said base is in use,
  (2) a second surface which is an undersurface when said base is in use,
  (3) a first end,
  (4) a second end,
  (5) a longitudinal axis which extends between the first end and the second end,
  (6) a first side,
  (7) a second side, and
  (6) a transverse axis which extends between the first side and the second side;

B) a layer of adhesive on the second surface of said base;

C) a zipper mechanism mounted on the first surface of said base to extend in the direction of the longitudinal axis of said base, said zipper mechanism including
  (1) a first surface which is an outside surface when said zipper mechanism is mounted on said base,
  (2) a second surface which is an inside surface when said zipper mechanism is mounted on said base, the second surface of said zipper mechanism being located adjacent to the first surface of said base when said zipper mechanism is mounted on said base, and
  (3) zipper teeth which are located adjacent to the first surface of said base when said zipper mechanism is mounted on said base and are separate from said base;

D) a row of stitches attaching said zipper mechanism to said base, said row of stitches extending in the direction of the longitudinal axis of said base; and E) a release liner which is releasably attached to said base by said layer of adhesive, said release liner including
  (1) a first section which extends between the first end of said base and the second end of said base and which has a first side edge located adjacent to the first side of said base and a second side located adjacent to said row of stitching,
  (2) a second section which extends between the first end of said base and the second end of said base and which has a first side edge located adjacent to said row of stitching,
  (3) said row of stitching separating the first section of said release liner from the second section of said release liner, and
  (4) the first and second sections of said release liner being separate and independent of each other whereby each of the first and second sections of said release liner can be removed from said base independent of the other sections of said release liner.

5. The improved zipper unit defined in claim 4 wherein the first side edge of the second section of said release liner is spaced apart from the second side edge of the first section of said release liner.

6. The improved zipper unit defined in claim 4 wherein the second side edge of the first section of said release liner is spaced apart from said row of stitches, the first side edge of the second section of said release liner is spaced apart from said row of stitches.

* * * * *